US005222988A

United States Patent [19]

Riley

[11] Patent Number: 5,222,988

[45] Date of Patent: Jun. 29, 1993

[54] GROMMET REINFORCEMENT DEVICE

[76] Inventor: A. Joseph Riley, P.O. Box 991, Battle Creek, Mich. 49016-0991

[21] Appl. No.: 746,743

[22] Filed: Aug. 19, 1991

[51] Int. Cl.[5] ..... B65D 55/00; F16L 5/00; F16B 21/00

[52] U.S. Cl. ..... 16/2; 411/339; 24/713.006

[58] Field of Search ..... 16/2; 24/713.6, 714.6, 24/714.8; 411/339

[56] References Cited

U.S. PATENT DOCUMENTS

| | | | |
|---|---|---|---|
| 48,103 | 6/1865 | Sawyer . | |
| 174,975 | 3/1876 | Pease . | |
| 682,376 | 9/1901 | Wood . | |
| 934,258 | 9/1909 | Adams . | |
| 1,873,736 | 8/1932 | Braunlich . | |
| 2,174,521 | 10/1939 | Lancaster | 411/339 X |
| 2,604,897 | 7/1952 | Cottor . | |
| 2,792,656 | 5/1957 | Glagousky . | |
| 2,807,850 | 10/1957 | Davidson | 24/713.6 |
| 3,121,271 | 2/1964 | Blomberg | 16/2 |
| 3,124,095 | 3/1964 | Kanser . | |
| 3,172,179 | 3/1965 | Schafer . | |
| 3,863,659 | 2/1975 | Gillis . | |
| 4,099,533 | 7/1978 | Gillis . | |
| 4,175,305 | 11/1979 | Gillis . | |
| 4,488,333 | 12/1984 | Tracy . | |
| 4,682,447 | 7/1987 | Osborn . | |
| 4,750,243 | 6/1988 | Davis . | |
| 4,761,860 | 8/1988 | Krauss | 24/713.6 |
| 4,777,705 | 10/1988 | Ingram . | |
| 4,903,698 | 2/1990 | Huber . | |
| 4,987,639 | 1/1991 | Baiuley . | |
| 5,031,268 | 7/1991 | McCabe | 16/2 |

*Primary Examiner*—John Sipos
*Assistant Examiner*—Carmine Cuda
*Attorney, Agent, or Firm*—Haugen and Nikolai

[57] ABSTRACT

Device for attaching a fastener to a tarpaulin or tent material which reinforces the area of attachment. The device is comprised of two body pieces with generally circular surfaces. A first body piece has an annular groove and concentrically disposed post adapted to fit into a socket and protrusion of the other body piece.

8 Claims, 1 Drawing Sheet

GROMMET REINFORCEMENT DEVICE

BACKGROUND OF THE INVENTION

The invention relates generally to a device to be positioned on a tarpaulin or tent to reinforce an existing grommet or to act as a grommet if none theretofore existed. A rope, bungie cord, stake or the like can be attached to the device to secure or attach the tarpaulin or tent to the ground or other object.

It is well-known in the art to use grommets or the like for attaching ropes, bungie cords, stakes or the like to tarpaulins or tents. They typically comprise an annulus inserted in an aperture found in the tent or tarpaulin material. The ropes, bungie cords or the like secure the tarpaulin or tent to objects such as the ground, a boat or a car. Twisting, pulling and straining actions while securing the tarpaulin or from the wind places a concentrated force on the grommets. Prior art grommets are not designed to spread these forces out over a larger area to eliminate the concentrated force on the grommet. As a result, grommets frequently rip out of the tarpaulin or tent material in the direction of the force. Once the grommet pulls out, the fabric often tears away. This is known as pullout.

There have been various approaches to prevent pullout. One such way is to reinforce the area with extra material. An example can be found in U.S. Pat. No. 2,604,987 to Cottor. Another approach has been to attach the fastener by hand without penetrating the material, as in U.S. Pat. No. 4,175,305 to Gillis.

What is needed is a grommet reinforcement device which is semi-permanent, requiring a tool to attach and detach, and one adapted for use either on tarpaulins having integrally formed grommets or on fabrics with no grommets.

The primary object is to provide a tarpaulin or tent fastener attachment which reinforces existing grommet locations to prevent pullout by spreading out the concentrated forces over a greater area of fabric.

Another object is to provide a tarpaulin fastener attachment which may be securely and semi-permanently attached to a sheet of fabric to provide a tie point that will withstand significantly larger forces than can typical brass thyroidal grommets commonly used today.

Yet another object is to provide a tarpaulin fastener attachment which reinforces the tarpaulin area to which the fastener is attached by spreading out the concentrated forces.

SUMMARY OF THE INVENTION

The grommet reinforcing device of the present invention comprises two molded bodies which are adapted to be positioned on opposite sides of the fabric to encompass the existing grommet on a tarpaulin or tent to reinforce it against pullout due to heavy loads, general wear and weathering effect. The first body piece comprises a generally circular member having an annular groove formed on a planar surface thereof and a concentrically disposed post projecting perpendicular to the plane of the annular groove. The other body piece also comprises a generally circular member but with an annular protrusion projecting from a planar surface thereof and adapted to fit into the annular groove on the first piece. A socket is centrally disposed on the second body piece for receiving the post of the first piece. The second piece additionally includes a radially projecting member having a central opening formed therein to which a rope, bungie cord or the like can be attached. In use, the two pieces of the grommet reinforcement device are positioned on opposite sides of the tarpaulin or tent grommet. The two body pieces are thus squeezed together with the fabric and the existing grommet sandwiched between them. The fabric is compressed into the annular groove and firmly held therein by the annular protrusion of the mating piece. Additionally, the device may be attached to a fabric area not having an existing grommet. Because of the tolerances between the post and socket, once it is squeezed together, the parts are held tightly in place with the fabric of the tarpaulin sandwiched in between.

DESCRIPTION OF THE DRAWINGS

These and other objects of the invention will become more readily apparent from the following detailed description taken in conjunction with the accompanying drawings in which.

DESCRIPTION OF THE PREFERRED EMBODIMENT

Figure 1:
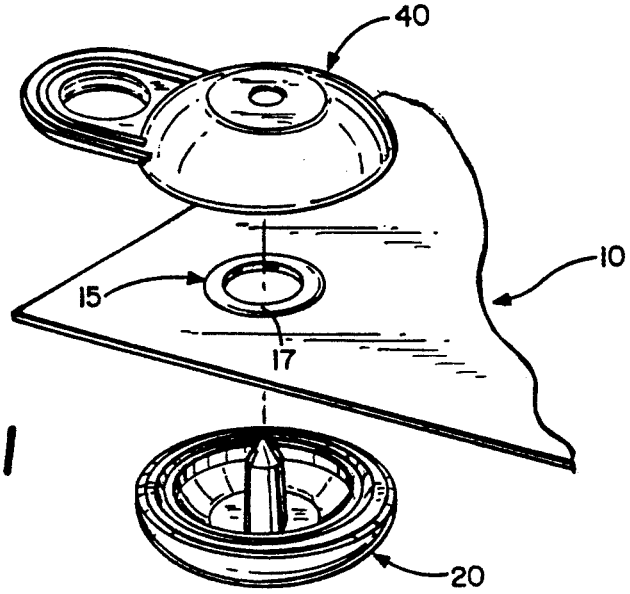
FIG. 1 is an enlarged exploded perspective view of the reinforcing device of the invention.

As shown in FIG. 1, the tarpaulin, tent or the like is made out of a cloth such as canvas or a fiber reinforced plastic sheet material and is shown generally at 10. A grommet 15 is crimped onto the fabric 10. The grommet has a central opening 17. The invention consists of a first body piece 20 and a second body piece 40 each of which will be described in further detail below.

Figure 3:
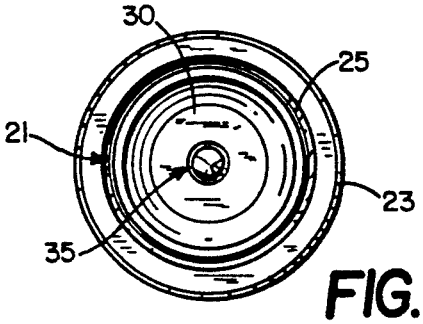
FIG. 3 is a plan view of the first body piece of the preferred embodiment.
Figure 2:
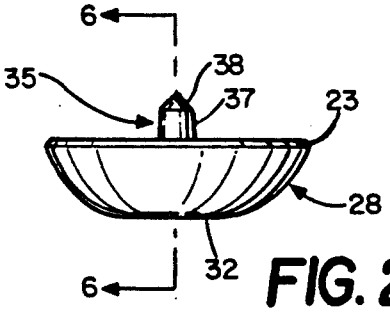
FIG. 2 is a side view of the first body piece of the preferred embodiment.
Figure 6:
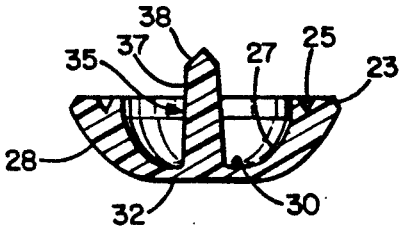
FIG. 6 is a cross-sectional view along line 6—6 of FIG. 2.

Turning now to FIGS. 2, 3 and 6, first body piece 20 is preferably molded from a suitable thermosetting plastic and has a generally circular shape when viewed as in FIG. 3. A first annular mating surface 21 is created on a flat upper edge and, as shown in FIGS. 2 and 6, the piece 23 is generally bowl-shaped on its exterior surface 28 and has a flat bottom surface 32.

An annular groove 25 is located inward of the outer edge 23 of the first mating surface 21. First mating surface 21 slopes inwardly to a first interior planar area 30 of a diameter smaller than that of the annular groove 25. Rising from the interior planar area 30 is a concentrically disposed tapered post 35. As can be seen from FIG. 6, post 35 extends above the first mating surface 21. Post 35 has a tapered stem 37 with conical, or pointed end 38.

Figure 4:
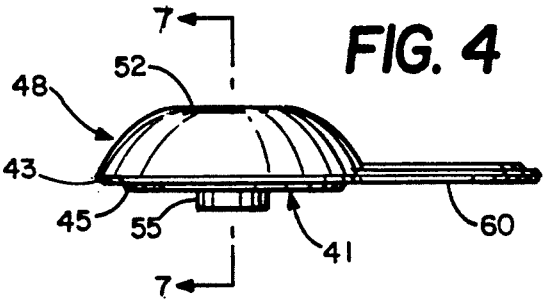
FIG. 4 is a side view of the second body piece of the preferred embodiment.
Figure 5:
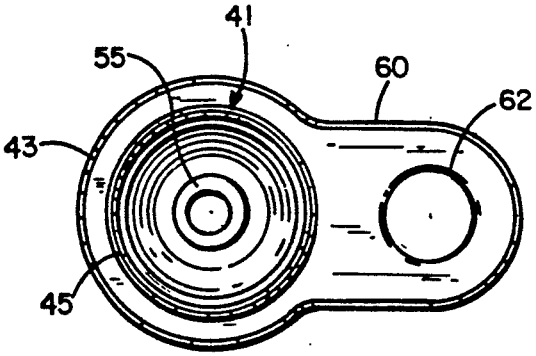
FIG. 5 is a plan view of the second body piece of the preferred embodiment.
Figure 7:
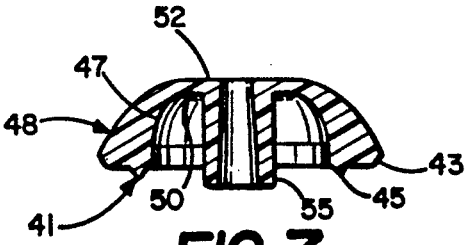
FIG. 7 is a cross-sectional view along line 7—7 of FIG. 4.

Referring now to FIGS. 4, 5, and 7, the second body piece 40 is seen to comprise a molded plastic body of generally circular shape when observed in a plan view. It has a second mating surface 41 and a second exterior surface 48 which, again, is generally bowl-shaped. Second exterior surface 48 extends from the second mating surface 41 to a second exterior central planar area 52 having a diameter smaller than outer edge 43 of second mating surface 41.

An annular protrusion 45 is located inward of the second mating surface's outer edge 43. Protrusion 45 is designed to securely fit into annular groove 25 located on the first body piece 20. The annular portion of the mating surface 41 surrounded by the annular protrusion 45 extends to an interior planar area 50 of a diameter smaller than the diameter of protrusion 45. A centrally disposed tubular socket 55 extends perpendicular from interior planar surface 50. Socket 55 is designed to receive the post 35 of first body piece 20. Integrally molded with the second body piece 40 and projecting radially from the outer edge 43 thereof is an ear member 60. An aperture is located therein, shown generally at 62.

Post 35 has a diameter slightly larger than the tapered bore in socket 55. This ensures that a tight tolerance is created when post 35 engages socket 55. A tool, such as a pliers, is required to engage body pieces 20 and 40 because of the tight tolerances which provide a predetermined friction fit.

The reinforcement device is utilized by placing the first body's mating surface 21 on one side of the fabric sheet 10. Post 35 extends through the opening 17 in grommet 15. The second body's mating surface 41 is placed opposite the first body and against the second side of the fabric. A tool, such as a pliers, is used to squeeze the first and second bodies together. Post 35 fits into socket 55 through the grommet's central opening. As post 35 engages socket 55, the grommet and surrounding material web is enclosed within the device. Protrusion 45 engages groove 25, sandwiching the fabric material between the first and second bodies.

Fasteners, such as ropes, bungies or stakes, which are used to secure the tarpaulin, tent or similar materials, are attached to the radially projecting member 60, instead of directly to the grommet. The device reinforces the grommet area by spreading the forces from general use such as tugging, pulling, and wind over a larger area, minimizing the potential for pullout. The circular shape uniformly distributes the force. However, it is clear that other shapes such as octagonal, triangular, rectangular or the like can also be used to reinforce the grommet area by spreading out the forces. Additionally, it is clear that the device is readily used on a fabric not containing grommets by piercing the material to make an opening through which post 35 may pass as the two pieces are forced together. Thus, the device operates in the same fashion as with an existing conventional grommet by spreading the forces over an area to minimize the potential for pullout.

Testing was performed to show the reinforcement capabilities of the device. The testing was set up to determine at what applied force would a tarp of reinforced plastic material containing a typical brass grommet and a grommet reinforced by the invention fail. The material fails when the grommet or the reinforce grommet completely tears out of the tarp material. The first test used a tarp containing a brass grommet similar to the one shown in FIG. 1. A rope was passed through the grommet. A testing machine applied a force on the rope in a direction away from the body of the tarp. The brass grommet tore out of the tarp when the applied force reached 96 N. The second test used the same tarp material with device of this invention reinforcing a brass grommet. A rope was passed through the invention's radially projecting ear member 60. The reinforced grommet did not tear out of the tarp until the applied force reached 396 N. This testing clearly shows the reinforcement capabilities of this device.

While the above provides a full and complete disclosure of the preferred embodiment of the present invention, various modifications, alternative constructions and equivalents will occur to those skilled in the art given the benefit of this disclosure, thus, the invention is not limited to the specific embodiments described herein, but as defined by the claims.

What is claimed is:

1. A device for reinforcing a grommet and a fabric sheet surrounding said grommet, said device comprising:

(a) a first body piece comprising a generally bowl-shaped member having a circular surface with an annular groove formed therein and a concentrically disposed solid, tapered post extending perpendicular to the plane of said circular surface;

(b) a second body piece comprising a generally bowl-shaped member having a circular surface and an annular protrusion extending from said circular surface adapted to fit into said annular groove of said first body piece, a tubular, tapered socket centrally disposed for receiving said solid post of said first body piece, and a radially projecting member having a central opening formed therethrough whereby when said first and second body pieces are placed on opposing sides of said grommet in said fabric sheet and squeezed together, said concentrically disposed tapered post engages said tapered socket through said grommet with said post and socket creating a friction fit while said annular protrusion squeezes said fabric sheet surrounding said grommet into said annular groove and sandwiching said fabric surrounding said grommet between said first and second body pieces.

2. The device of claim 1 wherein said first body piece has a radially projecting member having an opening formed therein.

3. The device of claim 1 wherein said second body piece has a radially projecting member having a central opening formed therein.

4. The device of claim 1 wherein said second body piece has an outwardly projecting tubular member, said socket being a bore formed in said outwardly projecting member.

5. A device for attaching a fastener to a fabric sheet, said device comprising:

(a) a first bowl-shaped body having a base and vertically sloping arcuate sidewalls terminating in an outer edge, a groove formed proximate said outer edge and a centrally disposed, solid tapered post projecting normally from said base;

(b) a second bowl-shaped body having a base and upwardly sloping arcuate sidewalls and a tapered protrusion adapted to fit into said groove of said first body, a socket projecting normally from said base and centrally disposed for receiving said solid post of said first body therein;

whereby when said first body is placed against a first side of said fabric sheet and said second body is placed opposite said first body against a second side of said sheet with the first and second bodies being squeezed together, said centrally disposed post projects into said centrally disposed socket with a friction fit and said protrusion engages said groove, sandwiching said fabric sheet between said first and second bodies.

6. The device of claim 5 wherein said first body has an integrally formed member projecting from said outer edge said member having an opening formed therein.

7. The device of claim 5 wherein said second body has an integrally formed member projecting from said outer edge, said member having an opening formed therein.

8. The device in claim 5 wherein the diameter of said post is slightly larger than the diameter of said socket, whereby a friction fit tight tolerance results.

* * * * *